US008121300B1

(12) United States Patent
LoDuca et al.

(10) Patent No.: US 8,121,300 B1
(45) Date of Patent: Feb. 21, 2012

(54) DRUM ACCESSORY FOR GATING OF A MICROPHONE ON A DRUM

(76) Inventors: Joseph A. LoDuca, Sterling Heights, MI (US); JoAnne LoDuca, Sterling Heights, MI (US)

( * ) Notice: Subject to any disclaimer, the term of this patent is extended or adjusted under 35 U.S.C. 154(b) by 324 days.

(21) Appl. No.: 12/576,104

(22) Filed: Oct. 8, 2009

(51) Int. Cl.
*H04R 29/00* (2006.01)

(52) U.S. Cl. ..... 381/56; 381/118; 381/122; 381/123; 84/104

(58) Field of Classification Search ..... 381/56, 381/61, 118, 119, 122, 123; 84/104, 461, 84/627, 663, 723, 745
See application file for complete search history.

(56) References Cited

U.S. PATENT DOCUMENTS 2,666,848 A 1/1954 Goodwin
4,809,337 A 2/1989 Scholz et al.
D324,687 S 3/1992 Olson
6,094,490 A 7/2000 Kim
7,038,117 B2 5/2006 Yoshino
2007/0107587 A1 5/2007 Lee
2008/0071958 A1 3/2008 Honda et al.

*Primary Examiner* — Vivian Chin
*Assistant Examiner* — Friedrich W Fahnert

(57) ABSTRACT

A drum accessory comprising a housing for attaching to a drum; a microprocessor disposed in the housing; an audio gate circuit disposed in the housing and operatively connected to the microprocessor and operatively connected to a microphone; and a drum trigger sensor operatively connected to the microprocessor, the drum trigger positioned to touch an edge of the drumhead of the drum; wherein the microprocessor is configured to receive a first input signal from the drum trigger sensor when the drum trigger sensor detects that the drum is hit, wherein upon receipt of the first input signal the microprocessor generates a first output command to the audio gate circuit to activate the audio gate circuit to allow transmission of an audio signal from the microphone to an output location; wherein the audio gate circuit is set to automatically deactivate after a predetermined amount of time.

7 Claims, 3 Drawing Sheets

DRUM ACCESSORY FOR GATING OF A MICROPHONE ON A DRUM

FIELD OF THE INVENTION

The present invention is directed to audio equipment used for recording music, more particularly to a combination drum trigger and noise gate for gating a microphone that is attached to a drum.

BACKGROUND OF THE INVENTION

A noise gate is an electronic device used to control audio signals. For example, a noise gate can allow a signal to pass through only when it is above a set threshold (e.g., when the gate is "open"). If the signal falls below the threshold, no signal is allowed to pass (e.g., the gate is "closed"). A noise gate does not remove noise from the signal; for example when the gate is open, both the signal and the noise will pass through.

Noise gates have a threshold control that is set to the level at which the gate will open. A release sets the amount of time that the gate is open. A fast release closes the gate immediately after the sound has fallen below the threshold, and a slow release slowly changes the gate from open to closed.

In a recording session, noise gates are used to help reduce the leakage of sound into a microphone from sources other than the one the microphone was intended for. In some situations, one microphone is used for one drum (e.g., snare drum) and one may be used for a second drum (e.g., kick drum). Generally, the snare drum produces a high level signal and the kick drum produces a low level signal. The threshold level of the noise gate can be set to isolate one of the two signals.

A drum trigger is a device attached to a drum hoop or a drumhead that detects when a drum is hit. When the drum is hit, it sends a signal to a drum module.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
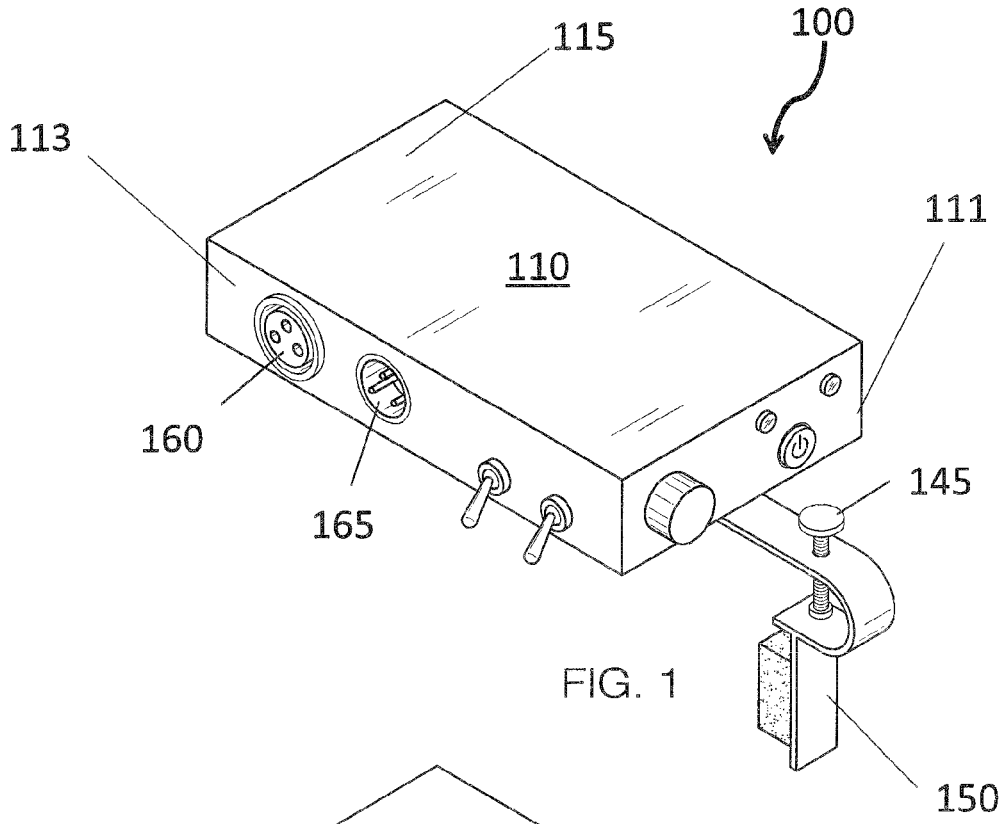
FIG. 1 is a perspective view of the drum accessory of the present invention.
Figure 2:
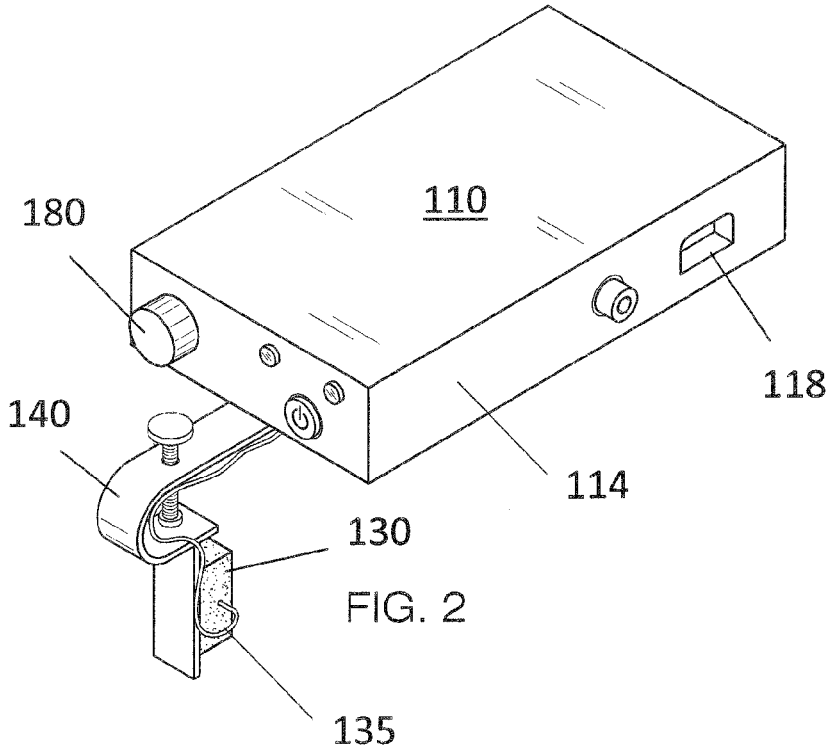
FIG. 2 is a perspective view of the drum accessory of FIG. 1.
Figure 3:
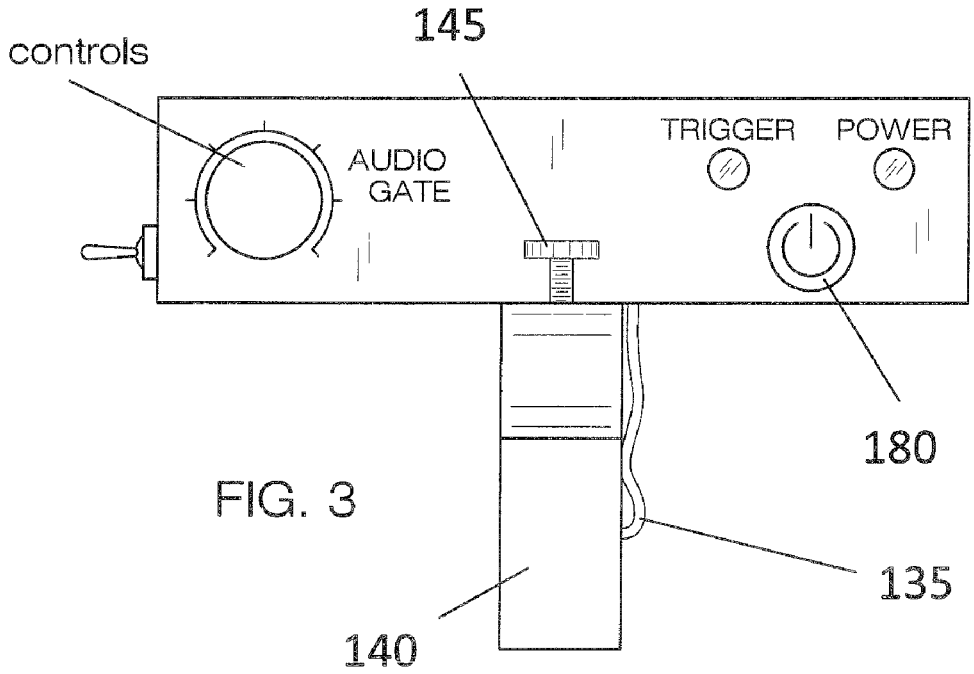
FIG. 3 is a front view of the drum accessory of FIG. 1.
Figure 4:
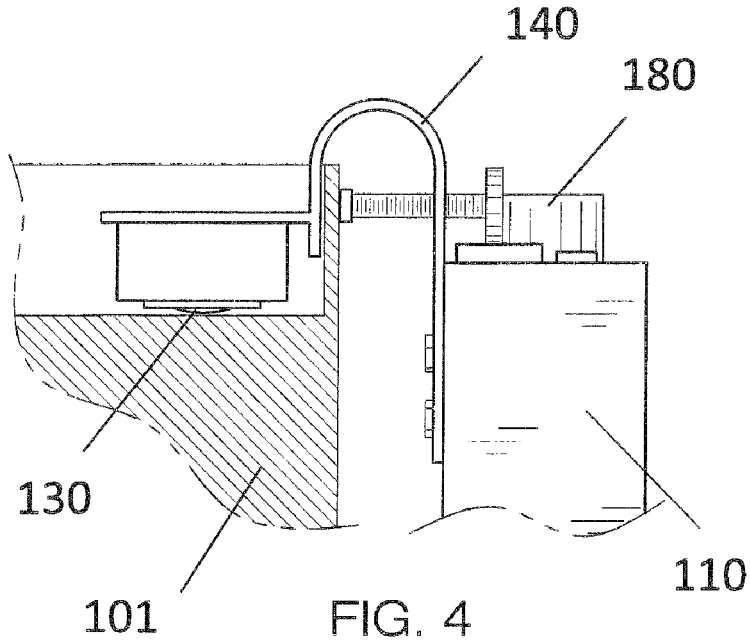
FIG. 4 is a side view of the drum accessory of FIG. 1.
Figure 5:
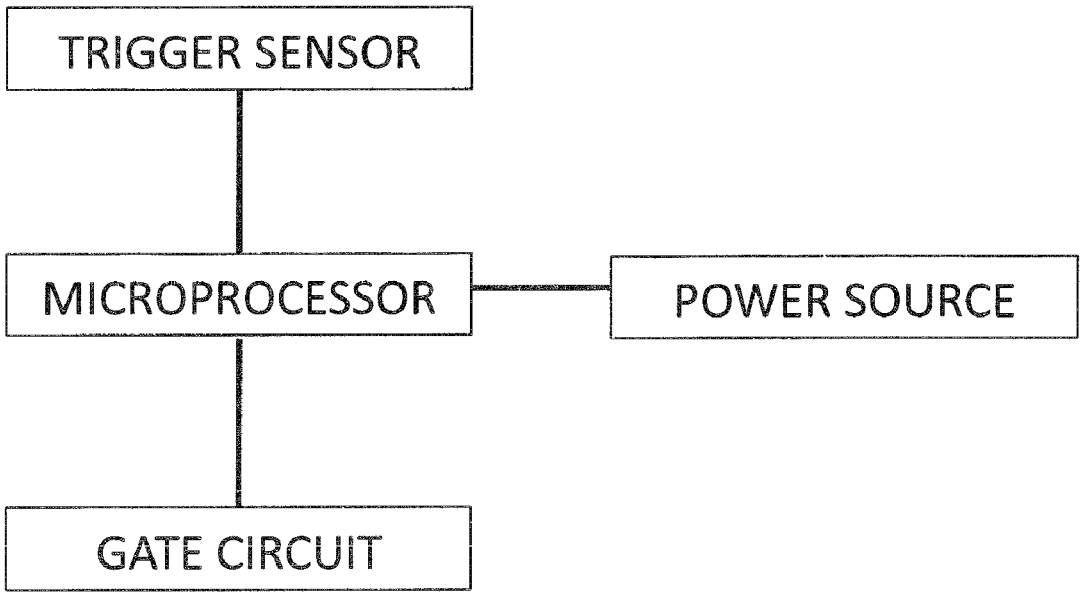
FIG. 5 is a schematic representation of electrical components of the drum accessory of the present invention.

Referring now to FIG. 1-5, the present invention features a drum accessory 100 for gating a microphone that is attached to a drum 101. The drum accessory 100 comprises a drum trigger and a noise gate. Without wishing to limit the present invention to any theory or mechanism, it is believed that the drum accessory 100 of the present invention is advantageous because it can allow for more accurate gating of a microphone applied to the drum. It can improve sound quality of the drum or drum set during live and recording applications. The drum accessory 100 can improve accuracy when gating microphones on a drum 101.

The drum accessory 100 comprises a housing 110 for attaching to a drum 101. The housing 110 may be of various shapes, for example generally rectangular. The housing 110 may have a first side 111, a second side 112, a third side 113, a fourth side 114, a top surface 115, a bottom surface 116, and an inner cavity. The housing 110 comprises a power source and/or is operatively connected to a power source. In some embodiments, the housing 110 comprises a power port 118 for connecting a power cord to the housing 110. Such power ports and power cords are well known to one of ordinary skill in the art.

The housing 110 may be temporarily attached to a drum 101 (e.g., the hoop of the drum 101) via an attachment means. For example, in some embodiments, the attachment means includes a mounting bracket 140 that can be temporarily secured to the drum 101, for example via a tightening bolt 145. For example, the tightening bolt 145 may be turned in a first direction to tighten the mounting bracket 140 and the bolt 145 may be turned in a second direction to loosen the mounting bracket 140. Such attachment means are well known to one of ordinary skill in the art. The attachment means is not limited to the aforementioned examples.

A standard microphone can be attached to the drum normally. The microphone is connected to the input port 160 and output port 165 of the device 100 (on the housing 110) via cables (e.g., XLR cables).

A wing 150 is disposed on the attachment means (e.g., mounting bracket 140). Attached to the wing 150 is a drum trigger sensor 130 for sensing when the drum is hit. The drum trigger sensor 130 is positioned to touch the edge of the drumhead. The drum trigger sensor 130 is operatively connected to a microprocessor. The microprocessor is operatively connected to a power source. When the drum trigger sensor 130 senses the drum being hit, it sends a first input signal to the microprocessor. The drum trigger sensor 130 is operatively connected to a power source, for example via a wire 135.

The microprocessor is operatively connected to the drum trigger sensor 130 and an audio gate circuit disposed in the housing 110. The audio gate circuit may be operatively connected to a microphone. When the drum trigger sensor 130 detects the drum is hit (e.g., vibration on drumhead), it sends the first input signal to the microprocessor. Upon receipt of the first input signal, the microprocessor generates a first output command to the audio gate circuit so as to activate/opens the gate circuit. When the gate circuit is open, transmission of the audio signal is allowed (e.g., from the microphone to the output destination such as a recording medium, speakers, etc.). The gate is then deactivated after a predetermined amount of time, effectively deactivating the microphone.

Without wishing to limit the present invention to any theory or mechanism, it is believed that the drum accessory 100 of the present invention can help ensure that high amplitude sounds from other drums and/or cymbals on the drum set do not open a gated microphone. This allows for tighter more accurate gating of the microphones on the drum set which enhance the overall sound quality both live and in studios.

The drum accessory 100 of the present further comprises a control switch 180 disposed on the housing 110. The control switch 180 allows the accessory 100 to be turned on and off. In some embodiments, the accessory comprises a phantom power switch. In some embodiments, the drum accessory 100 comprises a power source, which allows for the expandability and use of multiple drum accessories 100.

The housing 110 may be constructed in a variety of sizes. In some embodiments, the housing 110 is between about 4 to 6 inches in length as measured from the first side 111 to the second side 112. In some embodiments, the housing 110 is between about 6 to 8 inches in length as measured from the first side 111 to the second side 112. In some embodiments, the housing 110 is more than about 8 inches in length.

In some embodiments, the housing 110 is between about 1 to 2 inches in width as measured from the third side 113 to the fourth side 114. In some embodiments, the housing 110 is between about 2 to 4 inches in width as measured from the third side 113 to the fourth side 114. In some embodiments, the housing 110 is between about 4 to 6 inches in width as measured from the third side 113 to the fourth side 114. In some embodiments, the housing 110 is more than about 6 inches in width.

In some embodiments, the housing 110 is between about 0.25 to 1.0 inches in height as measured from the top surface 115 to the bottom surface 116. In some embodiments, the housing 110 is between about 1.0 to 2.0 inches in height as measured from the top surface 115 to the bottom surface 116. In some embodiments, the housing 110 is more than about 2.0 inches in height.

As used herein, the term "about" refers to plus or minus 10% of the referenced number. For example, an embodiment wherein the housing 110 is about 6 inches in width includes a housing 110 that is between 5.4 and 6.6 inches in width.

The following the disclosures of the following U.S. Patents are incorporated in their entirety by reference herein: U.S. Pat. No. 7,038,117; U.S. Pat. Application No. 2007/0107587; U.S. Pat. No. 2,666,848; U.S. Pat. No. 4,809,337; U.S. Pat. No. 6,094,490; U.S. Pat. Application No. 2008/0071958.

Various modifications of the invention, in addition to those described herein, will be apparent to those skilled in the art from the foregoing description. Such modifications are also intended to fall within the scope of the appended claims. Each, reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A drum accessory comprising:

(a) a housing for removably attaching to a drum via an attachment means;

(b) a microprocessor disposed in an inner cavity of the housing, the microprocessor operatively connected to a power source;

(c) an audio gate circuit disposed in the inner cavity of the housing and operatively connected to the microprocessor and operatively connected to a microphone; and (d) a drum trigger sensor operatively connected to the microprocessor, the drum trigger disposed on the attachment means and positioned to touch an edge of a drumhead of the drum, the drum trigger functioning to detect when the drum is hit by detecting vibration of the drum;

wherein the microprocessor is configured to receive a first input signal from the drum trigger sensor when the drum trigger sensor detects that the drum is hit, wherein upon receipt of the first input signal the microprocessor generates a first output command to the audio gate circuit to activate the audio gate circuit to allow transmission of an audio signal from the microphone to an output location; wherein the audio gate circuit is set to automatically deactivate after a predetermined amount of time.

2. The drum accessory of claim 1, wherein the housing is removably attached to a hoop of the drum.

3. The drum accessory of claim 1, wherein the attachment means includes a mounting bracket.

4. The drum accessory of claim 1, wherein the drum trigger sensor is operatively connected to a power source.

5. The drum accessory of claim 1, wherein the housing comprises a power port for connecting a power cord.

6. The drum accessory of claim 1 further comprising a control switch disposed on the housing for turning the drum accessory on and off.

7. The drum accessory of claim 1 further comprising a phantom power switch.

* * * * *